US009272822B2

(12) United States Patent
Samartgis

(10) Patent No.: US 9,272,822 B2
(45) Date of Patent: Mar. 1, 2016

(54) DISPENSING CLOSURE ASSEMBLY FOR A CONTAINER

(75) Inventor: Jim Samartgis, Eltham (AU)

(73) Assignee: The Decor Corporation Pty Ltd., Scoresby, Victoria (AU)

( * ) Notice: Subject to any disclaimer, the term of this patent is extended or adjusted under 35 U.S.C. 154(b) by 0 days.

(21) Appl. No.: 14/236,448

(22) PCT Filed: Aug. 20, 2012

(86) PCT No.: PCT/AU2012/000974

§ 371 (c)(1), (2), (4) Date: Mar. 20, 2014

(87) PCT Pub. No.: WO2013/023253

PCT Pub. Date: Feb. 21, 2013

(65) Prior Publication Data

US 2014/0217128 A1 Aug. 7, 2014

(30) Foreign Application Priority Data

Aug. 18, 2011 (NZ) ..... 594673

(51) Int. Cl.
*B65D 83/00* (2006.01)
*B65D 47/24* (2006.01)
(Continued)

(52) U.S. Cl.
CPC ..... *B65D 47/24* (2013.01); *B65D 47/088* (2013.01); *B65D 47/12* (2013.01); *B65D 47/148* (2013.01); *B65D 47/249* (2013.01)

(58) Field of Classification Search
CPC ..... B65D 47/24; B65D 47/088; B65D 47/12; B65D 47/148; B65D 47/249; B65D 45/06; B65D 43/22; B65D 41/16; B65D 47/08; B65D 47/14; B65D 51/18; B65D 41/28; B65D 43/0227; B65D 43/0229; B65D 45/04; B65D 45/14; B65D 45/20; B65D 47/0876
USPC ..... 222/469, 472, 505, 507, 556, 558; 220/262, 263, 318, 322, 846, 254.1, 220/254.3, 254.4; 215/235, 239, 240, 241, 215/242
See application file for complete search history.

(56) References Cited

U.S. PATENT DOCUMENTS 201,891 A * 4/1878 Prescott ..... 215/240
202,525 A * 4/1878 Doremus ..... 215/239
(Continued)

FOREIGN PATENT DOCUMENTS

WO WO 2006/016864 A1 2/2006

OTHER PUBLICATIONS

International Search Report for PCT/US04/22024, dated Aug. 3, 2005.

*Primary Examiner* — Patrick M Buechner
(74) *Attorney, Agent, or Firm* — Cook Alex Ltd.

(57) ABSTRACT

A dispensing closure assembly for a container includes a main body member which is adapted, in use, to be releasably affixable to the container, that main body member including a dispensing outlet and a control member, releasably associated with the main body member, and closure member which is releasably associated with both the main body member and the control member such that movement of the control member allows for selective and controlled movement of the closure member between respective end positions into, and out of, engagement with the dispensing outlet of the main body member.

24 Claims, 8 Drawing Sheets

(51) Int. Cl.

| | |
|---|---|
| ***B65D 47/12*** | (2006.01) |
| ***B65D 47/08*** | (2006.01) |
| ***B65D 47/14*** | (2006.01) |

(56) References Cited

U.S. PATENT DOCUMENTS

| | | | | | |
|---|---|---|---|---|---|
| 302,484 | A | * | 7/1884 | Haslage | 220/568 |
| 872,671 | A | * | 12/1907 | Nash | 222/556 |
| 1,689,057 | A | * | 10/1928 | Schwemlein | 220/263 |
| 1,743,293 | A | * | 1/1930 | Toft | 222/517 |
| 1,929,702 | A | * | 10/1933 | McDonald | 220/210 |
| 2,037,172 | A | * | 4/1936 | Leffert | 220/315 |
| 2,073,043 | A | * | 3/1937 | Albrecht | 215/307 |
| 2,099,847 | A | * | 11/1937 | Gebauer et al. | 222/425 |
| 2,149,795 | A | * | 3/1939 | Skoblin | 222/512 |
| 2,169,779 | A | * | 8/1939 | Loewe | 222/487 |
| 2,335,195 | A | * | 11/1943 | Packer | 222/469 |
| 2,378,451 | A | * | 6/1945 | Vensel | 239/337 |
| 2,574,876 | A | * | 11/1951 | Lebus | 222/473 |
| 2,630,242 | A | * | 3/1953 | Muller | 220/262 |
| 2,678,758 | A | * | 5/1954 | Richmond, Sr. | 222/469 |
| 2,748,997 | A | * | 6/1956 | Richmond, Sr. | 222/469 |
| 3,469,747 | A | * | 9/1969 | Richmond, Jr. | 222/469 |
| 3,770,160 | A | * | 11/1973 | Flider | 220/318 |
| 3,811,605 | A | * | 5/1974 | Flider | 222/472 |
| 3,934,328 | A | * | 1/1976 | Flider | 29/453 |
| 4,009,794 | A | | 3/1977 | Zapp | |
| 4,135,650 | A | * | 1/1979 | Schiemann | 222/572 |
| 4,489,860 | A | * | 12/1984 | Flider | 222/189.01 |
| 5,065,877 | A | * | 11/1991 | Karppinen et al. | 215/239 |
| 5,282,541 | A | | 2/1994 | Chen | |
| D679,541 | S | * | 4/2013 | Samartgis | D7/392.1 |
| 8,695,830 | B2 | * | 4/2014 | Meyers et al. | 220/254.3 |
| 8,905,252 | B2 | * | 12/2014 | Latham et al. | 215/306 |
| 2003/0010742 | A1 | * | 1/2003 | Kobilan | 215/235 |
| 2006/0043091 | A1 | * | 3/2006 | Pinelli et al. | 220/254.3 |
| 2007/0175931 | A1 | * | 8/2007 | Leoncavallo et al. | 222/556 |
| 2010/0224631 | A1 | * | 9/2010 | Roth et al. | 220/288 |
| 2010/0282703 | A1 | * | 11/2010 | Yang | 215/228 |
| 2011/0253733 | A1 | * | 10/2011 | Meyers et al. | 220/833 |
| 2012/0145713 | A1 | * | 6/2012 | Jung | 220/254.3 |
| 2014/0217128 | A1 | * | 8/2014 | Samartgis | 222/472 |

* cited by examiner

DISPENSING CLOSURE ASSEMBLY FOR A CONTAINER

FIELD OF THE INVENTION

The present invention relates, in general terms, to improvements in containers. More particularly, but not exclusively, the invention relates to an improved closure/dispensing means for a container.

BACKGROUND OF THE INVENTION

Nowadays containers are more and more often being employed for purposes of the containing, for purposes of short-term and/or long-term storage, of a variety of different substances, whether liquid or otherwise, and whether to be stored hot or cold. Such containers will invariably include a closure means associated therewith, which closure means will preferably include as a part thereof a means which allows for controlled dispensing of content from the overall container as and when desired.

Containers of this general type may include a dispensing closure means which is adapted, in use, to be releasably disposed over an open end of the container and which includes one or more dispensing orifices or the like means which communicate with the interior of the container and the content thereof. A cap or lid means may also be included to prevent unwanted spillage of content, as for example in the instance of inadvertent or accidental dropping of or tipping over of the container. Such a cap or lid means will also assist in keeping the contents of the container fresh and/or at the desired temperature, as well as reducing the possibility of ingress into the container of unwanted contaminants.

Prior art containers, by virtue of their principle of operation, have been prone to contamination of the contents thereof, this primarily because of the fact that, in order to open such containers and gain access to the content thereof, finger or hand pressure needs to be applied to the closure means itself. In contrast thereto, with the arrangement in accordance with the present invention opening of the associated closure means and access to the overall container and its contents is achieved or is possible without there being any need to directly contact the closure means. Such "remote" opening and closing eliminates any possibility of unwanted contamination of the content of such a container.

A closure and dispensing assembly for a container in accordance with the present invention may preferably constructed principally from a metallic material, as for example stainless steel. It should be understood, however, that the material of construction is not of the essence of the invention. Indeed the closure and dispensing assembly may be constructed from any suitable material, as for example a plastics material. The same can be said for the container, although preferably such will be constructed from a material such as stainless steel.

In accordance with the present invention there is provided a dispensing closure assembly for a container, said assembly including: a main body member adapted, in use, to be releasably affixable relative to said container, said main body member having a dispensing means associated therewith; a lever or control member adapted to be releasably associated with said main body member; and a flap or closure member which is adapted to be releasably associated with both said main body member and said lever or control member, the arrangement being such that movement of said lever or control member allows for selective and controlled movement of said flap or closure member between respective end positions into, and out of, engagement with said dispensing means of said main body member.

DESCRIPTION OF THE DRAWINGS

In order that the invention may be more clearly understood and put into practical effect there shall now be described in detail preferred constructions of an improved closure means for a container in accordance with the invention. The ensuing description is given by way of non-limitative example only and is with reference to the accompanying drawings, wherein.

DESCRIPTION OF PREFERRED EMBODIMENTS

Figure 1:
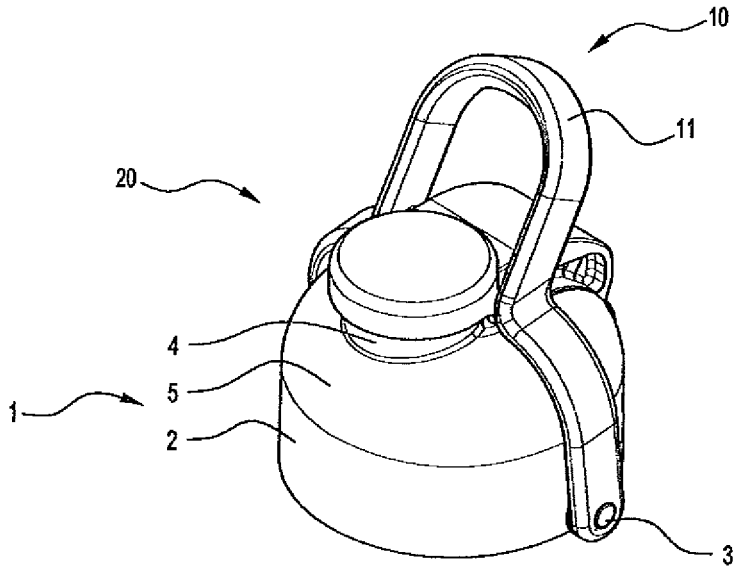
FIG. 1 is a front perspective view from above of one preferred embodiment of an improved closure assembly in accordance with the present invention.
Figure 2:
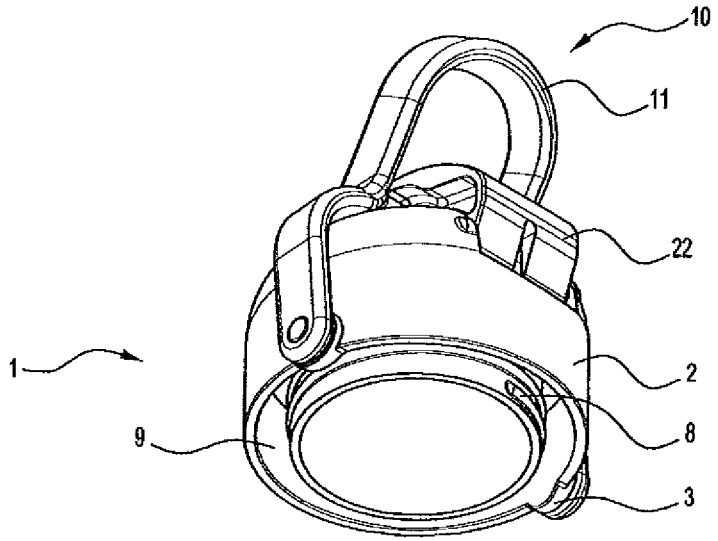
FIG. 2 is a rear perspective view from below of the embodiment of FIG. 1.
Figure 3:
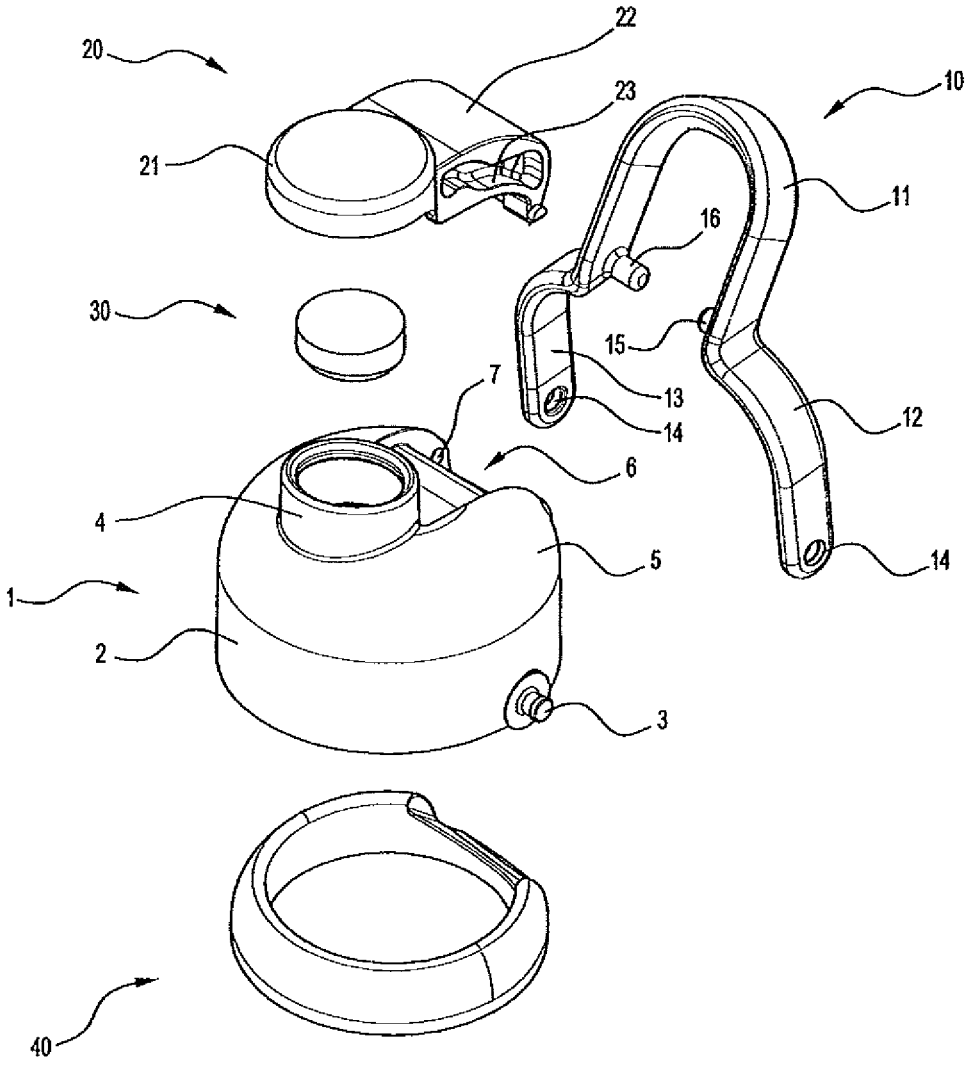
FIG. 3 is an exploded view, from above, of the embodiment of FIG. 1, showing the various components separated.
Figure 4:
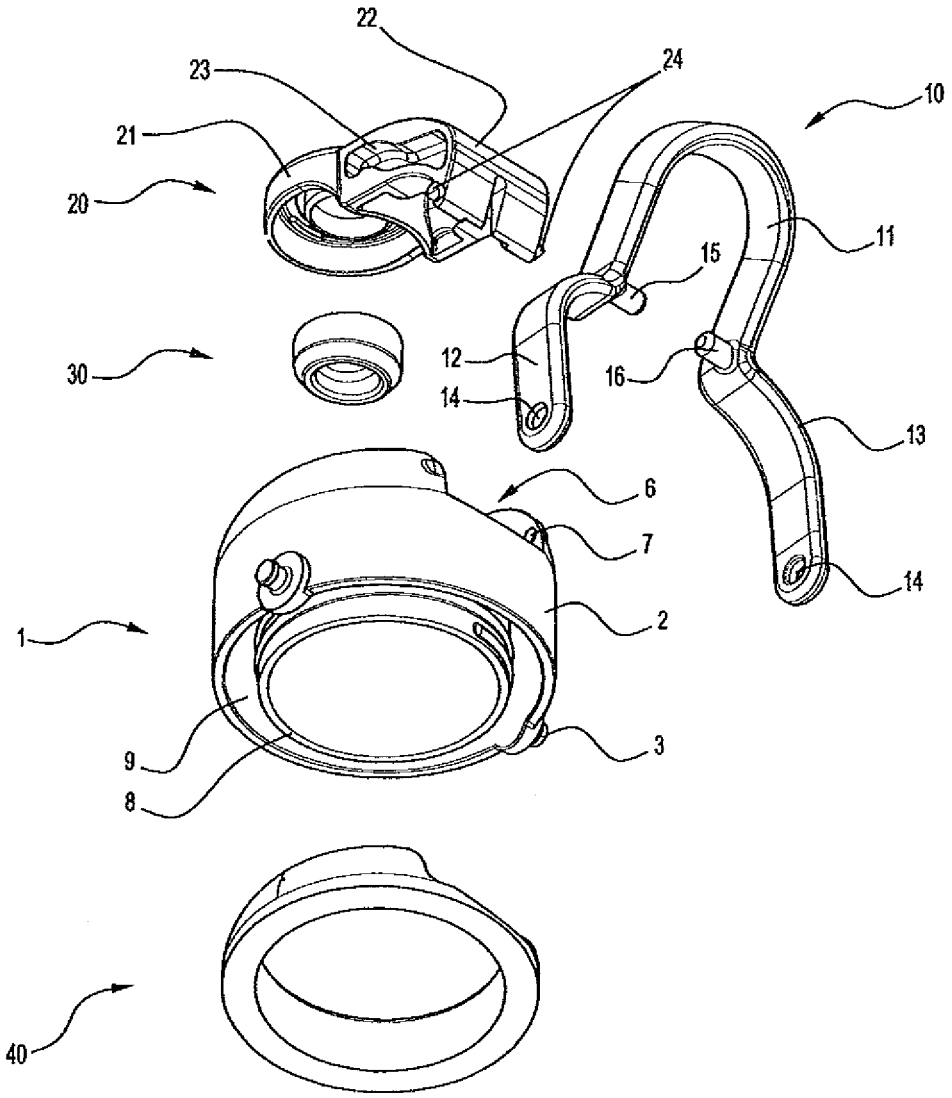
FIG. 4 is a view similar to FIG. 3, as a rear perspective view from below of the embodiment of FIG. 1.
Figure 5:
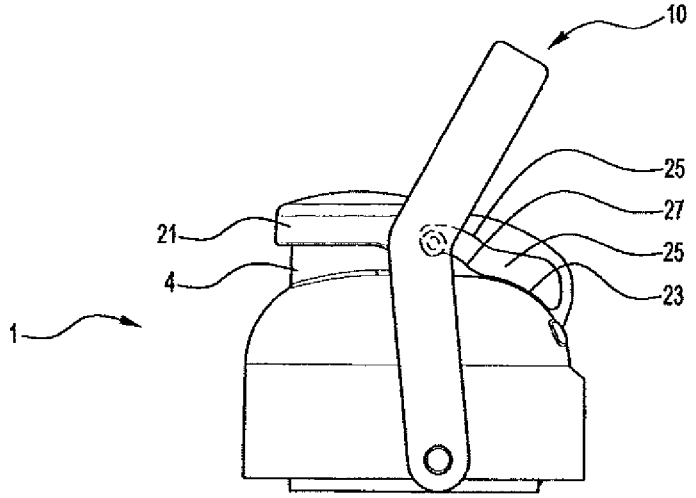
FIG. 5 is a side elevational view of the embodiment of FIG. 1, showing the various components interacting.
Figure 6:
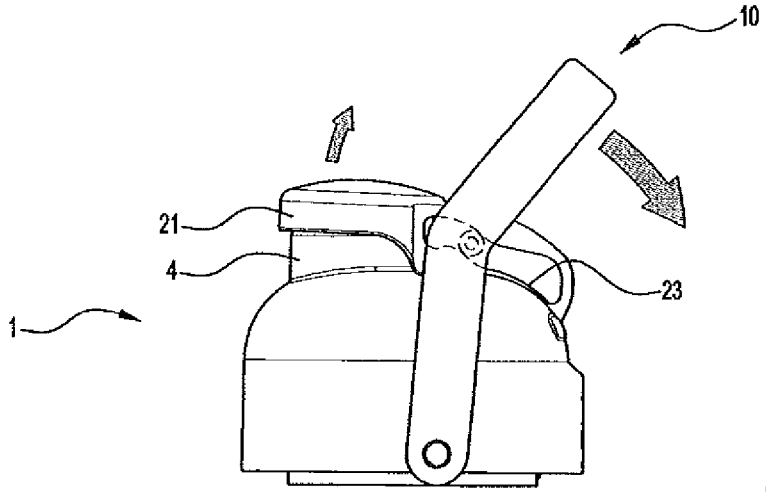
FIG. 6 is a view, similar to FIG. 5, showing movement of the lever to the disengaging position.
Figure 7:
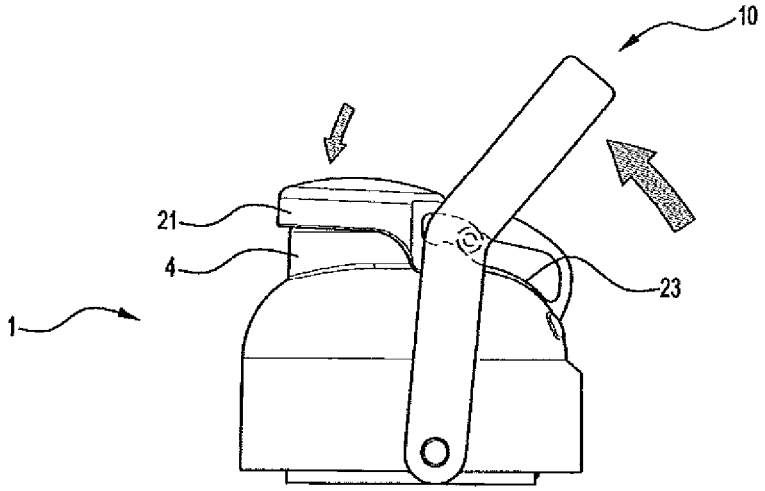
FIG. 7 is a view, similar to FIGS. 5 and 6, showing the principle behind the locking action for the assembly.
Figure 8:
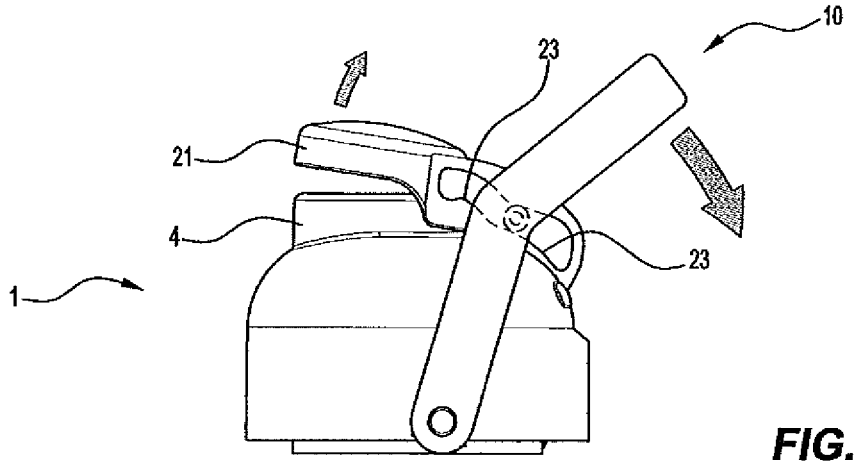
FIGS. 8 and 9 are views, similar to FIG. 5, illustrating movement of the lever.

With reference now to the drawings, and firstly to the embodiment of FIGS. 1 to 9, a cap or closure assembly in accordance with this preferred embodiment of the present invention includes five (5) principal components, namely a main body member 1, a lever member 10 which is adapted, in use, to be releasably associated with the main body member 1, a flap member 20 which is adapted, in use, to be releasably associated with the lever member 10 and to be selectively and progressively movable into and out of relationship with the main body member 1, a sealing means 30 which is adapted to co-operate with both the flap member 20 and the main body member 1, and a further sealing means 40 which is adapted, in use, to be associated with the main body member I and a container (not shown) to which the cap or closure assembly of the invention is to be releasably attachable. These various components will now each be described in more detail.

The main body member 1 is adapted, in use, to be removably/releasably attachable to a container, with the interposition of the further sealing means 40. That body member 1, as shown in the drawings, is preferably in the form of a substantially cylindrical member 2 of any suitable material, as for example plastics or stainless steel, having substantially diametrically opposed lugs 3 disposed at or in the vicinity of the lower free end thereof. The main body member 1 further includes, at the other end thereof, a neck or spout 4 extending substantially normally from the upper closed surface 5 thereof, to allow for dispensing of the contents of a container to which the cap or closure assembly may be releasably attached. In the preferred embodiment illustrated the neck or spout is disposed at a location displaced from the edge of the upper closed surface 5 of the main body member 1. There is preferably formed in the upper surface 5 of the main body member 1 a recessed section 6 which has opposed apertures 7 formed therein as shown (for a purpose to be explained hereinafter).

The main body member 1 further includes, disposed internally thereof and extending substantially normally from the upper closed surface 5 thereof towards the lower free end of the main body member 1, a protrusion or projection 8 which creates, with the outer cylindrical wall of the main body member 1, an annular region 9 into which may be disposed a threaded neck portion (not shown) of a container (not shown). In the embodiment shown in FIGS. 1 to 9 the protrusion or projection 8, dependent downwardly from the closed surface 5 of the main body member 1, extends to at least the free outer end of the cylindrical side wall of the main body member 1, preferably extending to a limited extent beyond that free outer end. In the especially preferred embodiment shown the protrusion or projection 8 includes, on the outer surface thereof and at or in the vicinity of the lower free end thereof, a threaded section, intended in use to co-operate with a complementary threaded section of the neck portion of the container to which the cap assembly is to be releasably attachable.

The lever member 10, of any suitable material and preferably of a plastics material, is shaped as shown and includes a centrally disposed and substantially U-shaped section 11 which has shaped, opposed leg members 12 and 13 extending angularly from opposed free ends thereof. Each leg member 12, 13 includes, at or in the vicinity of the free end thereof, an aperture 14. The lever member 10 also includes opposed lug members 15 and 16 disposed, as shown, at or in the vicinity of the junction of the U-shaped section 11 with the leg members 12, 13. The lever member 10 can also function as a carry member for the container.

The flap member 20 includes, as principal components, a cap member 21 which is substantially cylindrical in shape and a shaped arm member 22 adapted to extend therefrom and from one side thereof. The arm member 22 includes opposed tracks 23 each having a plurality of ramp sections formed therein. The flap member 20 further includes, at or in the vicinity of the free end of the arm member 22, opposed lugs or the like protrusions 24 which, in use, are adapted to be located in apertures 7 of the main body member 1, whereby to allow for releasable connection therebetween.

The seal 30 is preferably in the form of a cap member which is adapted, in use, to be disposed within and preferably retained within the cap member 21 of flap member 20 and to be disposed over the spout or neck 4 of the main body member 1, to prevent unwanted egress of the contents of the container. The seal 30 may be formed from any suitable material.

As shown in the drawings, a track 23 of the arm member 22 includes a number of specific elements or sections. The first of these is a disengaging ramp section 25, sited closest to the cap member 21, which ramp section 25 in use allows the flap member 20 to lift in an upward direction so as to disengage the seal 30 from the spout or neck 4 of the main body member 1. The next ramp section is a track or flat which allows the flap member 20 to swing away from and return into engagement with the spout or neck 4 of the main body member 1. There is also included an anti-tamper ramp 26 which allows the lever member 10 to continue and lock the flap member 20 in place should that flap member 20 be snapped closed by action directly thereon. The fourth section is a locking ramp and interface section 27.

The further seal 40 is shaped as shown and is intended, in use, to be interposed between the main body member 1 and the top or neck portion of the container, whereby to enhance sealing of the container. The seal 40 may be formed from any suitable material.

In use the assembly of components 1, 10, 20, 30 and 40 is appropriately disposed around/on the top or neck portion of a suitable container. Application of hand pressure to the lever member 10 will result in rotation of that lever member 10 relative to the main body member 1, which in turn will result in movement of the lug members 15 and 16 of lever member 20, with those lug members 15 and 16 being able to move along the tracks 23 of flap member 20. As a consequence that flap member 20 is movable into and out of engagement with the spout or neck 4 of the main body member 1.

The principle of operation of the assembly in accordance with the invention will now be described in more detail, this with particular reference to FIGS. 5 to 9 of the drawings.

Figure 9:
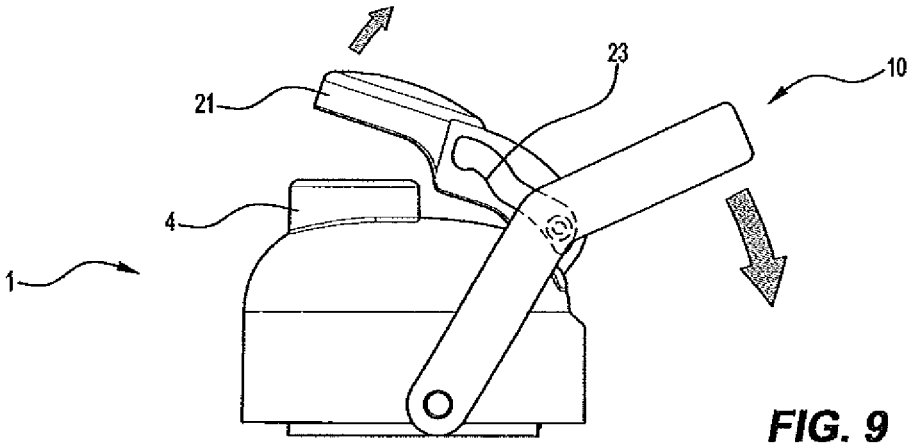
Figure 10:
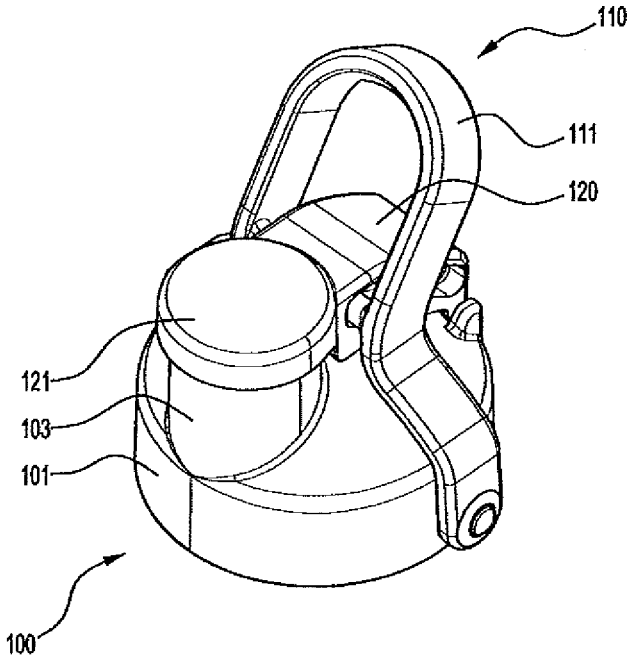
FIG. 10 is a front perspective view from above of a further preferred embodiment of an improved closure assembly in accordance with the present invention.
Figure 11:
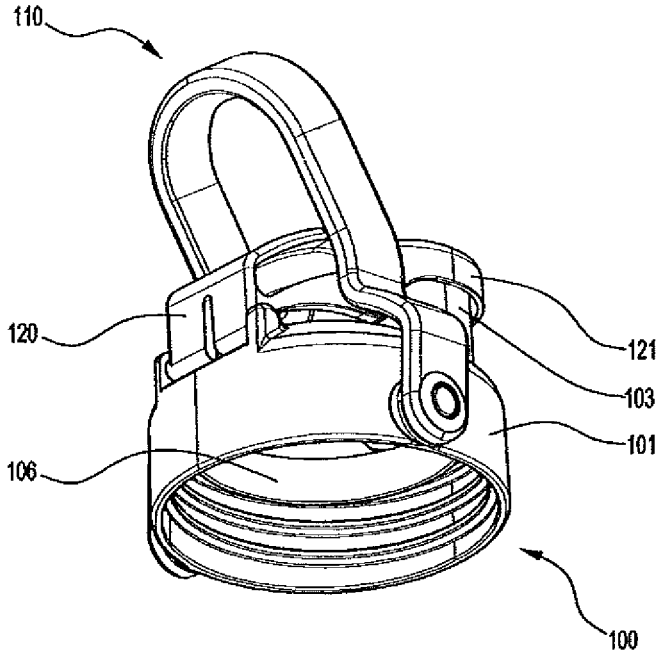
FIG. 11 is a rear perspective view from below of the embodiment of FIG. 10.
Figure 12:
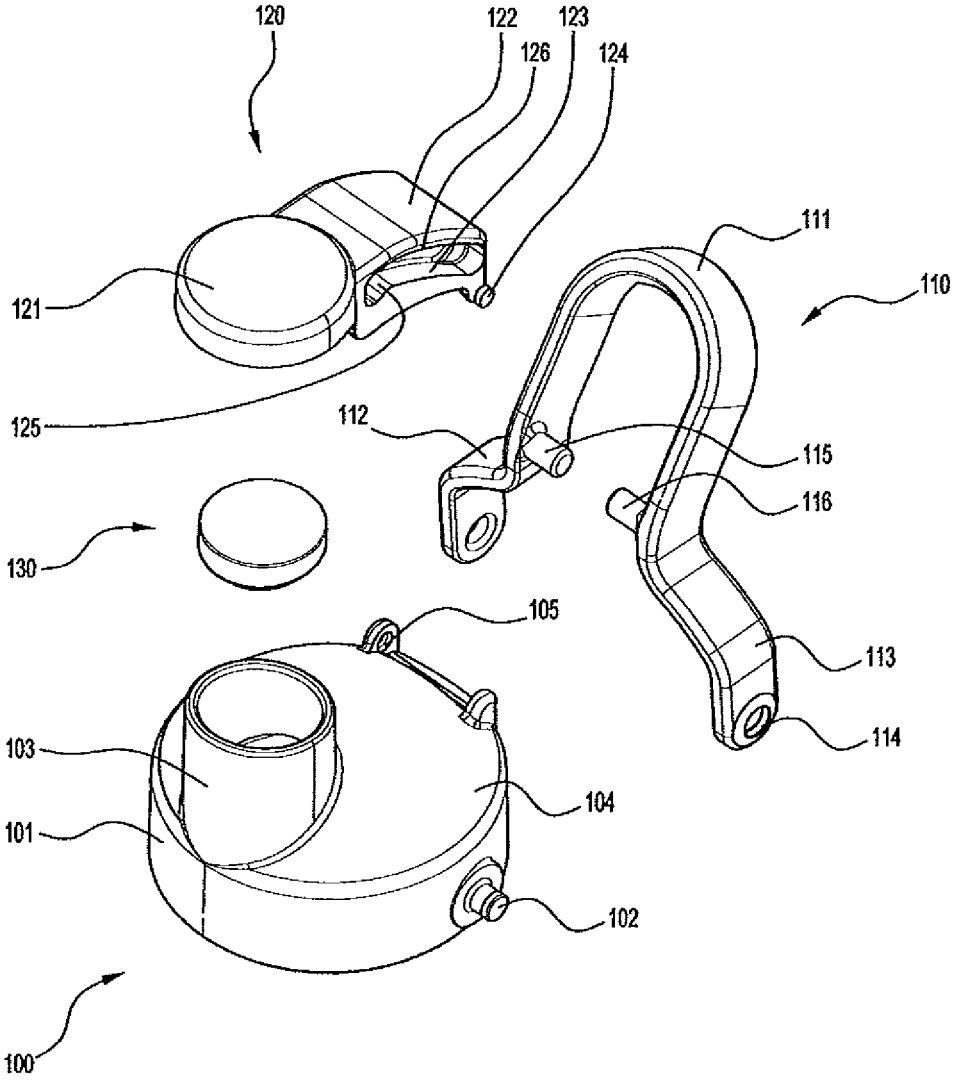
FIG. 12 is an exploded view, from above, of the embodiment of FIGS. 10 and 11, showing the various components separated.
Figure 13:
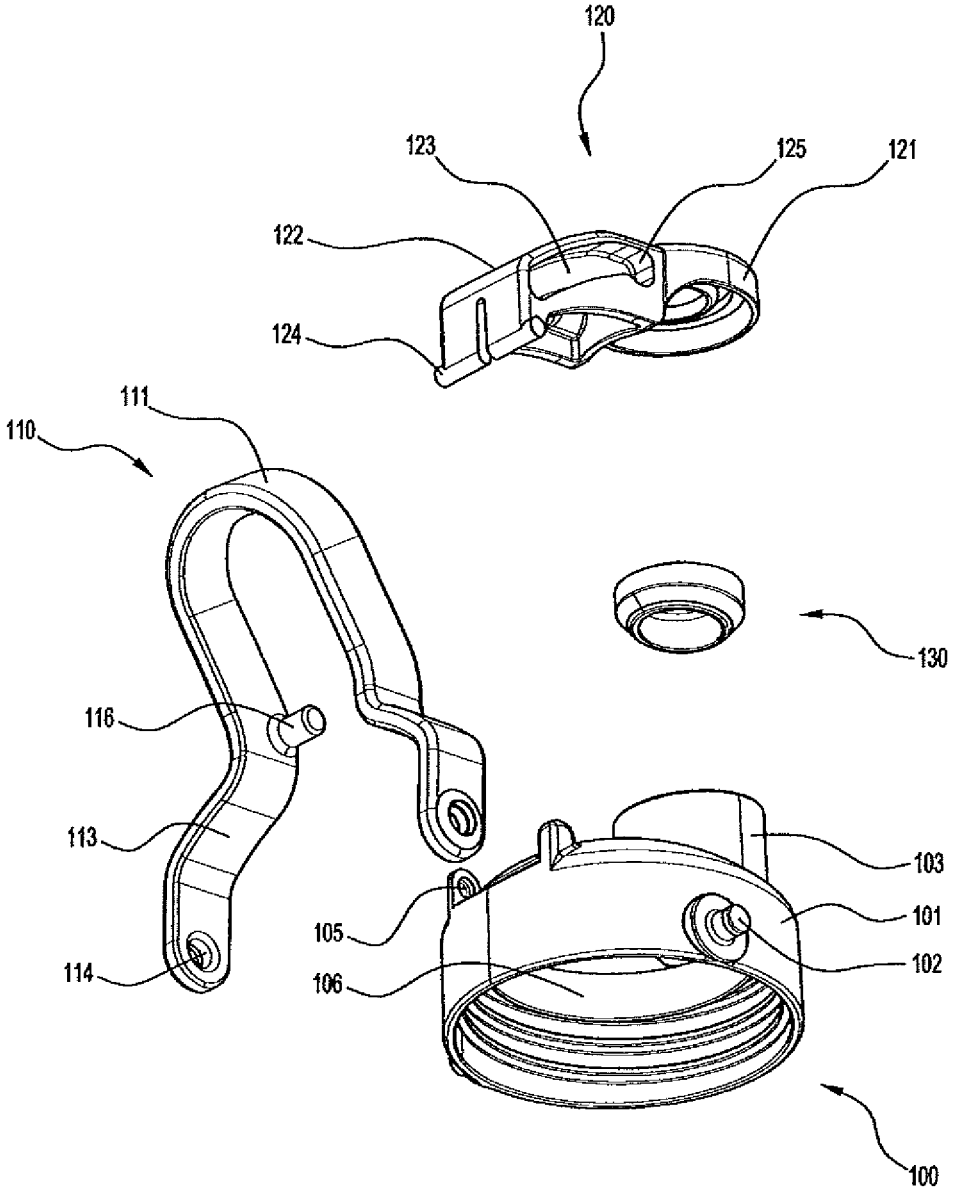
FIG. 13 is a view similar to FIG. 12, as a rear perspective view from below of the embodiment of FIGS. 10 and 11.

The application of hand or finger pressure to the lever member 10 allows for controlled movement thereof along the tracks 23 of the flap member 20. When the lever member 10 is, for example, in the position shown in FIG. 8, then the flap member 20 can be pushed into its "closed" position, thereby to seal the spout or neck 4 of the main body member 1. As the lever member 10 is moved further, to for example the position as shown in FIG. 9, it can be returned to the locking position, with the actuating pins or lug members 15 and 16 engaging the anti-tamper ramp section 25, lifting the flap member 20 and allowing the lever member 10 to pass through that section without any possibility of jamming.

Turning then to the embodiment of FIGS. 10 to 13, a cap or closure assembly in accordance with this embodiment of the invention includes four (4) principal components, namely a main body member 100, a lever member 110 which is adapted, in use, to be releasably associated with the main body member 100, a flap member 120 which is adapted, in use, to be releasably associated with the lever member 110 and to be selectively and progressively movable into and out of relationship/engagement with the main body member 100, and a sealing means 130 which is adapted to co-operate with both the flap member 120 and the main body member 100. These various components will now each be described in more detail.

The main body member 100 is adapted, in use, to be removably/releasably attachable to a container. That main body member 100, as shown in the drawings, is preferably in the form of a substantially cylindrical member 101 of any suitable material, as for example plastics or stainless steel, having substantially diametrically opposed lugs 102 disposed at or in the vicinity of the lower free end thereof. The main body member 100 further includes, at the other end thereof, a neck or spout 103 extending substantially normally from the upper closed surface 104 thereof and, in the preferred embodiment shown, such spout 103 is located at or in the vicinity of the outer periphery of the surface 104 to allow for dispensing of the contents of a container to which the cap or closure assembly may be releasably attached. In the preferred embodiment shown in the drawings the main body member 100 further includes, at the side edge of the surface 104 thereof and diametrically opposed to said spout 103, a pair of upwardly extending eyelets 105. In the alternative, the main body member 100 could include a recessed section, with opposed apertures, similar to that of the embodiment of FIGS. I to 9.

The main body member 100 further includes, disposed internally thereof and extending substantially normally from the upper closed surface 104 thereof towards the lower free end of the main body member 100, a truncated protrusion or projection 106 which creates, with the outer wall of the main body member 1, an annular region into which may be disposed a threaded neck portion of a container (not shown). In the embodiment shown in FIGS. 1 to 9 the protrusion or projection 8, dependent downwardly from the closed surface 5, extends to at least the free outer end of the side wall of the main body member 1, preferably extending to a limited extent beyond that free outer end. In the preferred embodiment shown in FIGS. 10 to 13 the main body member 100 includes, on the inner surface thereof and extending over at least a portion of the length thereof, a threaded section which is intended in use to co-operate with a complementary threaded section of the neck portion of the container to which the cap assembly is to be releasably attachable.

The lever member 110, of any suitable material and preferably of a plastics material, is shaped as shown and includes a centrally disposed and substantially U-shaped section 111 which has shaped, opposed leg members 112 and 113 extending angularly from opposed free ends thereof. Each leg member 112, 113 includes, at or in the vicinity of the free end thereof, an aperture 114. The lever member 110 also includes opposed lug members 115 and 116 disposed, as shown, at or in the vicinity of the junction of the U-shaped section 111 with the leg members 112, 113. The lever member 10 can also function as a carry member for the container.

The flap member 120 includes, as principal components, a cap member 121 which is substantially cylindrical in shape and a shaped arm member 122 adapted to extend therefrom and from one side thereof. The arm member 122 includes opposed tracks 123 each having a plurality of ramp sections formed therein. The flap member 120 further includes, at or in the vicinity of the free end of the arm member 122, opposed lugs or the like protrusions 124 which, in use, are adapted to be located in apertures 101 of the main body member 100, whereby to allow for releasable connection therebetween.

The seal 130 is preferably in the form of a cap member which is adapted in use to be disposed within and preferably retained within the cap member 121 of flap member 120 and to be disposed over the spout or neck 103 of the main body member 100, to prevent unwanted egress of the content of the container. The seal 130 may be formed from any suitable material.

As shown in the drawings, a track 123 of the arm member 122 includes a number of specific elements or sections. The first of these is a disengaging ramp section 125, sited closest to the cap member 121, which ramp section 125 in use allows the flap member 120 to lift in an upward direction so as to disengage the seal 130 from the spout or neck 103 of the main body member 100. The next ramp section is a track or flat which allows the flap member 120 to swing away from and return into engagement with the spout or neck 103 of the main body member 100. There is also included an anti-tamper ramp 124 which allows the lever member 110 to continue and lock the flap member 120 in place should that flap member 120 be snapped closed by action directly thereon. The fourth section is a locking ramp and interface section.

In use, and as with the earlier embodiment; the assembly of components 100, 110, 120, and 130 is appropriately disposed around/on the top or neck portion of a suitable container. Application of hand or finger pressure to the lever member 110 will allow for rotation of that lever member 110 relative to the main body member 100, which in turn will allow for movement of the lug members 115 and 116 of lever member 120, with those lug members 115 and 116 being able to move along the tracks 123 of flap member 120. As a consequence that flap member 120 is movable into and out of engagement with the spout 103 of the main body member 100.

The principle of operation of the assembly in accordance with the embodiment of FIGS. 10 to 13 is the same as that with the embodiment of FIGS. 1 to 9.

The cap or closure assembly in accordance with the present invention exhibits a number of advantages when compared with the prior art arrangements.

Firstly, since the lever member 10 is operable by the user to open and close the flap member 20, then unwanted contamination of the drinking or dispensing spout 4, and the contents of the container, is minimised, if not removed altogether.

Secondly the lever member, which also functions as a carry handle, by having a "kink" in its side profile (as shown in the drawings), provides a biased load on the locking mechanism (the flap) member when the container or flask is being carried. This ensures a load in the direction of locking during any impact, as for example as might be incurred by the container or flask when carried by a jogger or the like.

Finally, it is to be understood that the aforegoing description refers merely to preferred embodiments of the invention, and that variations and modifications will be possible thereto without departing from the spirit and scope of the invention, the ambit of which is to be determined from the following claims.

The claims defining the invention are as follows:

1. A dispensing closure assembly for a container, said assembly including:

a main body member adapted, in use, to be releasably affixable to said container, said main body member having a dispensing means associated therewith;

a lever or control member adapted to be releasably associated with said main body member;

a flap or closure member adapted to be releasably associated with both said main body member and said lever or control member, the arrangement being such that movement of said lever or control member allows for selective and controlled movement of said flap or closure member between respective end positions into, and out of, engagement with said dispensing means of said main body member;

said main body member having a cylindrical hollow member having one end thereof open and including, at the other opposed closed end thereof, a surface extending across the closed end of the cylindrical member which includes said dispensing means;

said dispensing means being in the form of a pouring spout associated with, and extending beyond the closing surface of said main body member;

said pouring spout being disposed at a position on said surface which is spaced from the peripheral outer cylindrical wall of said main body member;

said main body member also including at, or in the vicinity of the free open end thereof, opposed outwardly projecting lugs;

said surface of said main body member including a recessed portion, including opposed apertures or blind bores in the free end thereof;

means for releasably associating said main body member with said container;

said main body member further including a substantially cylindrical projection, extending downwardly from said surface of said main body member in a direction towards the free end of said main body member;

said substantially cylindrical protection being truncated, extending downwardly from said surface of said main body member but not protruding beyond the free open end thereof;

said main body member including a plurality of threads extending along at least part of the internal side wall thereof, to co-operate in use with complementary threads provided on said container; and said lever or control member including a substantially U-shaped member having opposed leg members extending angularly from each end thereof, said lever or control member further including, at or in the vicinity of the junction of the U-shaped central member and the opposed leg members, opposed internally-directed lug members or actuating pins.

2. The assembly as claimed in claim 1, wherein each said leg member of said lever or control member includes, at or in the vicinity of a free end thereof, an aperture.

3. The assembly as claimed in claim 2 wherein said flap or closure member includes a shaped cap portion which is adapted, in use, to overlay and co-operate with said dispensing means of said main body member, and a shaped arm member formed integrally therewith and extending therefrom, said arm member having a shaped track formed in each side thereof which is adapted, in use, to releasably receive and co-operate with said lugs or actuating pins of said lever or control member.

4. The assembly as claimed in claim 3, wherein said shaped arm member of said flap or closure member includes, at or in the vicinity of the free end thereof, opposed outwardly projecting pins which are adapted, in use, to be located within said each aperture of said main body member.

5. The assembly as claimed in claim 4, wherein each said track includes a plurality of ramps therein.

6. The assembly as claimed in claim 5, including a sealing means adapted, in use, to be interposed between said flap member and said main body member and to seal said dispensing means of said main body member.

7. The assembly as claimed in claim 6, including a further sealing means which is adapted, in use, to co-operate with said main body member and a top of said container, said further sealing means to be interposed, releasably, between said main body member and said container.

8. A dispensing closure assembly for a container, including:

a cap which is adapted to engage with the container and be releasably affixable to the container, the cap including a main body, of a substantially cylindrical shape which is open at one end, including an upper surface which extends transversely of the main body and an outer peripheral wall which extends downwardly from and substantially normally to the upper surface, the upper surface including a dispensing outlet disposed substantially centrally thereof and extending upwardly therefrom wherein the main body includes, extending downwardly from the upper surface, an inner peripheral wall which forms with the outer peripheral wall, an annular space for receiving, and co-operating with, a neck of the container;

a control member which is releasably associated with the main body member of the cap; and a closure member, releasably associated with both the main body member of the cap and the control member, the arrangement being such that movement of the control member allows for selective and controlled movement of the closure member between respective end positions into, and out of, engagement with the dispensing outlet of the main body, wherein said closure member includes a shaped cap portion which in use, overlays and co-operates with said dispensing outlet of said main body, and a shaped arm member formed integrally therewith and extending therefrom, said arm member having a shaped track formed in each side thereof which, in use, releasably receives and co-operates with the control member.

9. The assembly as claimed in claim 8, wherein the dispensing outlet is in the form of a pouring spout associated with, and extending beyond, the upper surface of the main body member.

10. The assembly as claimed in claim 9, wherein the pouring spout is disposed at or in the vicinity of an edge of the upper surface of the main body member.

11. The assembly as claimed in claim 10, wherein the pouring spout is disposed at a position on the upper surface which is spaced from the outer peripheral wall of the main body.

12. The assembly as claimed in claim 11, wherein the main body includes, at or in the vicinity of the lower free end of the outer peripheral wall, opposed outwardly projecting lugs.

13. The assembly as claimed in claim 12, wherein the upper surface of the main body includes a recessed portion, including opposed apertures.

14. The assembly as claimed in claim 13, including means for releasably associating the main body with the container.

15. The assembly as claimed in claim 8, wherein the inner peripheral wall is of substantially the same height dimension as the outer peripheral wall.

16. The assembly as claimed in claim 8, wherein the inner peripheral wall has a lesser height dimension than the outer peripheral wall.

17. The assembly as claimed in claim 8, wherein the inner peripheral wall of said cap has a plurality of threads extending along at least part of the height dimension thereof, to co-operate in use with complementary threads provided on the neck of the container.

18. The assembly as claimed in claim 8, wherein the main body includes a plurality of threads extending along at least part of the internal side wall thereof, to co-operate in use with complementary threads provided on the neck of the container.

19. The assembly as claimed in claim 18, wherein the control member includes a substantially U-shaped member having opposed leg members extending angularly from each end thereof, the control member further including, at or in the vicinity of the junction of the U-shaped central member and the opposed leg members, opposed internally-directed lugs.

20. The assembly as claimed in claim 19, wherein each leg member of the control member includes, at or in the vicinity of the free end thereof, an aperture.

21. The assembly as claimed in claim 20, wherein said shaped arm member of the closure member includes, at or in the vicinity of the free end thereof, opposed outwardly projecting pins adapted, in use, to be located within said apertures of said main body.

22. The assembly as claimed in claim 8, wherein each track of the closure member includes a plurality of ramps therein.

23. The assembly as claimed in claim 22, including a sealing means adapted to be interposed between the closure member and the main body and to seal the dispensing outlet of the main body.

24. The assembly as claimed in claim 23, including a further sealing means adapted to co-operate with the main body and a top of the container, the further sealing means to be interposed, releasably, between the main body and the container.

* * * * *